US010493324B2

(12) United States Patent
Sbragia

(10) Patent No.: US 10,493,324 B2
(45) Date of Patent: Dec. 3, 2019

(54) BALANCE EXERCISER FOR USE AT WORK

(71) Applicant: Diversified Healthcare Development, LLC, Fallbrook, CA (US)

(72) Inventor: Dean G. Sbragia, Fallbrook, CA (US)

(73) Assignee: Diversifited Healthcare Development, LLC, Fallbrook, CA (US)

( * ) Notice: Subject to any disclaimer, the term of this patent is extended or adjusted under 35 U.S.C. 154(b) by 250 days.

(21) Appl. No.: 15/413,695

(22) Filed: Jan. 24, 2017

(65) Prior Publication Data

US 2017/0239527 A1 Aug. 24, 2017

Related U.S. Application Data

(60) Provisional application No. 62/299,133, filed on Feb. 24, 2016.

(51) Int. Cl.
*A63B 24/00* (2006.01)
*A63B 26/00* (2006.01)

(52) U.S. Cl.
CPC ..... *A63B 26/003* (2013.01); *A63B 24/0087* (2013.01); *A63B 2220/18* (2013.01); *A63B 2220/56* (2013.01); *A63B 2225/62* (2013.01)

(58) Field of Classification Search
CPC ..... A63B 26/003; A63B 24/0087; A63B 2225/62; A63B 2220/56; A63B 2220/18; A63B 26/00; A63B 21/00; A63B 21/02; A63B 21/04; A63B 21/0442; A63B 21/055; A63B 21/0552; A63B 21/0555; A63B 21/0557; A63B 71/009; A63B 71/0054; A63B 21/0407
See application file for complete search history.

(56) References Cited

U.S. PATENT DOCUMENTS 2,978,243 A * 4/1961 Gabrielson ..... A63G 1/00 472/135
4,108,428 A * 8/1978 Winterbottom ..... A63B 69/20 482/84
4,126,326 A * 11/1978 Phillips ..... A63B 26/003 280/205
4,516,768 A * 5/1985 Gallaro ..... A63B 21/0004 482/140
4,787,630 A * 11/1988 Watson ..... A63B 22/14 482/146
5,033,742 A * 7/1991 Johnson ..... A47C 15/006 441/130
5,092,586 A * 3/1992 Tuthill ..... A63B 21/0004 482/146
5,112,045 A * 5/1992 Mason ..... A63B 22/18 482/112
5,613,690 A * 3/1997 McShane ..... A63B 22/18 273/449
5,690,389 A * 11/1997 Ekman ..... A47C 3/16 248/599

(Continued)

*Primary Examiner* — Garrett K Atkinson
(74) *Attorney, Agent, or Firm* — Gibb & Riley, LLC

(57) ABSTRACT

A low-cost balance exerciser for use at work includes a central support for a ball joint disposed on a base, an inflatable elastic toroidal bladder disposed on the base and centered about the central support, a rigid circular balance platform whose center is fixed to the ball joint on its lower surface, and a pump connected to the inflatable elastic toroidal bladder.

4 Claims, 1 Drawing Sheet

(56) References Cited

U.S. PATENT DOCUMENTS 5,897,474 A * 4/1999 Romero ..... A63B 22/14 446/396
6,872,175 B2 * 3/2005 Lin ..... A63B 21/0004 482/121
D505,460 S * 5/2005 Dalebout ..... D21/671
7,008,359 B2 * 3/2006 Fan ..... A63B 22/18 482/146
7,044,558 B2 * 5/2006 Chiu ..... A47C 4/54 297/217.1
7,357,766 B2 * 4/2008 Langer ..... A63B 21/0004 482/146
7,431,681 B1 * 10/2008 St. Cyr ..... A63B 21/0552 482/121
7,438,696 B2 * 10/2008 Koonar ..... A61H 1/005 601/46
7,563,216 B1 * 7/2009 Kest ..... A63B 22/16 482/140
7,601,107 B2 * 10/2009 Maloy ..... A63B 23/1209 482/123
7,985,164 B2 * 7/2011 Ashby ..... A63B 22/02 434/247
8,460,161 B2 * 6/2013 Cole ..... A63B 21/0552 482/148
8,632,440 B2 * 1/2014 Pratson ..... A63B 21/0552 273/458
9,364,699 B2 * 6/2016 Gordon ..... A63B 5/11
9,776,030 B1 * 10/2017 Louis ..... A63B 26/003
2004/0018924 A1 * 1/2004 Szydlowski ..... A63B 21/0004 482/146
2004/0023766 A1 * 2/2004 Slone ..... A63B 22/18 482/146
2004/0087421 A1 * 5/2004 Lin ..... A63B 21/0004 482/146
2005/0049123 A1 * 3/2005 Dalebout ..... A63B 21/04 482/142
2005/0170939 A1 * 8/2005 Lin ..... A63B 23/0211 482/148
2006/0030795 A1 * 2/2006 Luberski ..... A63B 22/18 601/1
2007/0265138 A1 * 11/2007 Ashby ..... A63B 22/02 482/8
2008/0280740 A1 * 11/2008 Knecht ..... A61B 3/113 482/146
2014/0081177 A1 * 3/2014 Eguibar ..... A61B 5/1036 600/595
2015/0108803 A1 * 4/2015 Bay ..... A47C 7/402 297/311
2015/0157888 A1 * 6/2015 Gordon ..... A63B 5/11 446/220

* cited by examiner

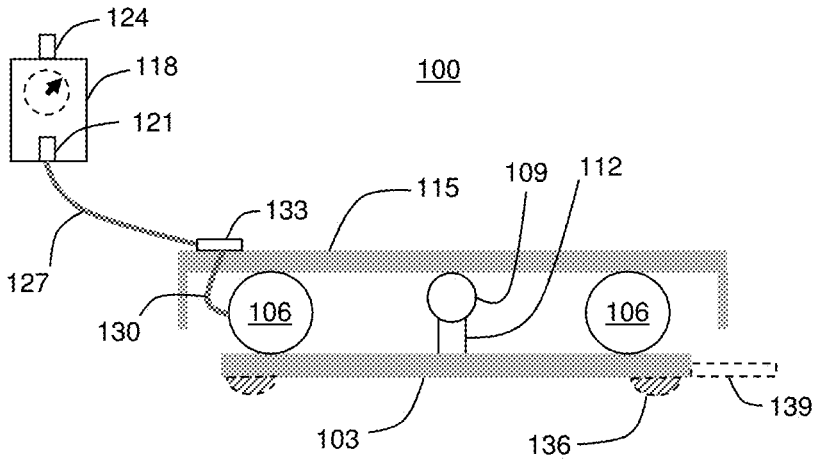
FIG. 1
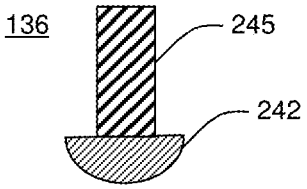
FIG. 2
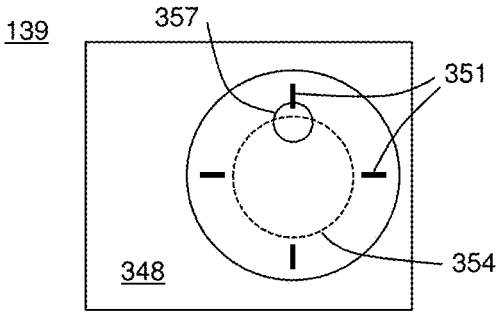
FIG. 3
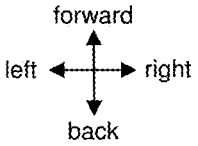

BALANCE EXERCISER FOR USE AT WORK

CROSS-REFERENCE TO RELATED APPLICATIONS

The present invention claims the benefit under 35 U.S.C. § 120 of U.S. Provisional Application Ser. No. 62/299,133 filed on Feb. 24, 2016, the entire teachings of which are incorporated herein by reference.

FIELD OF THE INVENTION

The present disclosure generally relates to a low-cost balance exerciser, upon which a user stands, for use at work.

DESCRIPTION OF RELATED ART

Increasing the physical activity of desk workers, while at work, provides health benefits. Many devices are now available to increase physical activity in the workplace. Exercise desks have been described that include treadmills, stationary bicycles, and elliptical trainers. Adjustable height desks allow workers to alternately stand and sit while working. Ball chairs require a worker to balance upon a spherical cushion, which forms the seat of a chair.

A kinesthetic diagnostic and rehabilitation device has been described, in which the device includes an inclinometer on the bottom of a balance platform that electrically communicates with a computer. While a patient exercises, the inclinometer sends inclination data to the computer to indicate an instantaneous inclination of the balance platform over time. The computer correlates the instantaneous inclination data to a degree of kinesthetic impairment of the patient.

SUMMARY

An exemplary embodiment of a balance exerciser for use at work may include a central support for a ball joint disposed on a base. The balance exerciser may also include an inflatable elastic toroidal bladder disposed on the base and centered about the central support. Finally, the balance exerciser may further include a rigid circular balance platform whose center is fixed to the ball joint on its lower surface.

Another exemplary embodiment of a balance exerciser for use at work may include a central support for a ball joint disposed on a base. The balance exerciser may also include an inflatable elastic toroidal bladder disposed on the base and centered about the central support. The balance exerciser may further include a rigid circular balance platform whose center is fixed to the ball joint on its lower surface. Finally, the balance exerciser may yet further include a pump that connects to and inflates the inflatable elastic toroidal bladder, and is external to the balance exerciser.

Yet another exemplary embodiment of a balance exerciser for use at work may include a central support for a ball joint disposed on a base. The balance exerciser may also include an inflatable elastic toroidal bladder disposed on the base and centered about the central support. The balance exerciser may further include a rigid circular balance platform whose center is fixed to the ball joint on its lower surface. Finally, the balance exerciser may yet further include a pump that connects to and inflates the inflatable elastic toroidal bladder and is external to the balance exerciser, the pump including a flow control valve to control flow and pressure of inflating air to the inflatable elastic toroidal bladder and a ball check valve to release or maintain the pressure.

BRIEF DESCRIPTION OF THE DRAWINGS

The embodiments of the inventions described herein will be better understood from the following detailed description with reference to the drawings, which are not necessarily drawn to scale and in which:

FIG. 1 illustrates, in a cross section view, a balance exerciser for use at work in an embodiment of the invention;

FIG. 2 illustrates, in a cross section, an adjustable leveling foot of the balance exerciser for use at work in an embodiment of the invention; and FIG. 3 illustrates a top view of the bubble level indicator including marks to indicate direction of tilt and magnitude of tilt of the base of the balance exerciser in an embodiment of the invention.

DETAILED DESCRIPTION

FIG. 1 illustrates a cross section of an embodiment of a low-cost balance exerciser 100 for use at work. An exemplary embodiment of the balance exerciser 100 includes a base 103, upon which a central support 112 for a ball joint 109 and an inflatable elastic toroidal bladder 106 are disposed. The inflatable elastic toroidal bladder 106 is centered about the central support 112 and the ball joint 109. The ball joint 109 is fixed to the underside of a rigid circular balance platform 115 at its center and the elastic toroidal bladder is sandwiched between the underside of the rigid circular balance platform 115 and the base 103. The diameter of the balance platform 115 is greater than that of the outer diameter of the inflatable elastic toroidal bladder 106 and has a peripheral edge that extends down beyond the central bottom surface of the balance platform 115.

The ball joint 109 allows the rigid circular balance platform 115 to tilt in any direction of the horizontal x-y plane. The user's center of gravity relative to the center of the balance platform 115 and the inflation pressure of the inflatable elastic toroidal bladder 106 determine the direction of tilt of the balance platform 115 in any of the 360° of the x-y plane and the magnitude of tilt of the balance platform 115 along the z-axis, which is generally measured in angular degrees. While standing on the balance platform 115, forward and backward or side-to-side movements by the user cause the user's center of gravity to shift, resulting in corresponding changes in direction and magnitude of tilt for the balance platform 115.

In an exemplary embodiment of the invention, when the inflatable elastic toroidal bladder 106 is inflated to a maximum pressure, the balance platform 115 is relatively stable and large movements by the user result in only small changes in the magnitude of tilt. However, when the inflatable elastic toroidal bladder 106 is inflated to less than maximum pressure, the balance platform 115 is less stable and smaller movements by the user result in comparatively larger changes in the magnitude of tilt. In an exemplary embodiments, the maximum downward tilt of the balance platform 115 along the z-axis in any direction of the horizontal x-y plane may preferably be limited to less than or equal to 20° by a section of the peripheral edge of the balance platform 115 that touches the ground at the maximum downward tilt. More preferably, the maximum downward tilt by the balance platform 115 in any direction of the horizontal x-y plane may be limited to less than or equal to 15°. Of course, a downward tilt in one direction of the horizontal x-y plane by the balance platform 115 results in an equal upward tilt of the opposite side of the balance platform 115 about its center.

Referring to FIG. 1, a pump 118 inflates the inflatable elastic toroidal bladder 106 of the balance exerciser 100 in an exemplary embodiment of the invention. In various embodiments, the pump 118 may include any one of: an air stand pump, an air hand pump, an air foot pump, and an air electric pump. The pump 118 may include a flow control valve 121, to control the flow and pressure of the inflating air to the inflatable elastic toroidal bladder 106, and a ball check valve 124, to release or maintain the pressure. In an exemplary embodiment, inflating air may travel from the pump 118 through the flow control valve 121 to an air hose 127 that may connect to a pressure gauge 133 and to an air line 130, which connects to the inflatable elastic toroidal bladder 106.

Alternatively, a valve stem may (not shown) may be connected to the air line 130, which connects to the inflatable toroidal bladder 106. The pump 118 may then be connected to the valve stem to inflate the inflatable toroidal bladder 106. The inflatable toroidal bladder 106 may be deflated by disconnecting the air hose 127 from the valve stem and the stem of the valve stem deflected sideways to allow air to escape from the inflatable toroidal bladder 106.

In an exemplary embodiment, the pressure gauge 133 may be attached to an upper surface of the balance platform 115. The pressure gauge 133 may indicate a pressure of the inflatable elastic toroidal bladder 106 ranging from, for example, a minimum pressure of 0 pounds per square inch (psi) to a maximum pressure of 20 psi. The pressure gauge 133 may be connected directly or indirectly to the inflatable elastic toroidal bladder 106. Alternatively, the external pump 118 may include a pressure gauge (dotted circle) that indicates the pressure of the inflatable elastic toroidal bladder 106.

In another exemplary embodiment of the invention, adjustable leveling feet 136 may be positioned on the bottom surface of the base 103 of the balance exerciser 100. Preferably, four adjustable leveling feet 136 are positioned in a quadrilateral pattern to allow leveling relative to forward, backward, left and right directions. A bubble level indicator 139 may extend laterally from the base 103, so that the user may readily determine a level of the balance exerciser 100. As shown in FIG. 2, each adjustable leveling foot 136 may include a foot 242 and a threaded stud 245 that is advanced into or retracted from a corresponding threaded hole (not shown) in the base 103 of the balance exerciser 100.

Referring to FIG. 3, adjusting the level of the base 103 of the balance exerciser is facilitated by the bubble level indicator 139, a support 348 for which extends laterally from the base 103 and which may include marks 351 indicating forward, backward, left, and right directions of tilt and a circular mark 354 indicating a pre-defined magnitude of tilt in any of the 360° of direction relative to the ground in an exemplary embodiment of the invention. For example, the bubble 357 may indicate the balance exerciser 100 is tilted forward by 5°.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated).

As used herein, the singular forms "a", "an" and "the" are intended to include the plural forms as well, unless the context clearly indicates otherwise. It will be further understood that the terms "includes" and/or "including," when used in this specification, specify the presence of stated features, steps, operations, elements, and/or components, but do not preclude the presence or addition of one or more other features steps, operations, elements, components, and/or groups thereof.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A balance exerciser, consisting essentially of:

a central support for a ball joint disposed on a base;

an inflatable elastic toroidal bladder disposed on the base and centered about the central support;

a rigid circular balance platform whose center is fixed to the ball joint on its lower surface and whose periphery is supported by the inflatable elastic toroidal bladder, the rigid circular balance platform tilting about the ball joint in any direction of the horizontal x-y plane;

an external pump disposed externally to the rigid circular balance platform and the base, the external pump having a flow control valve to inflate the inflatable elastic toroidal bladder and a ball valve to release or maintain air pressure in the inflatable elastic toroidal bladder, the flow control valve connecting to an external air hose that connects to a pressure gauge, which indicates a pressure of the inflatable elastic toroidal bladder, and to an air line that connects to the inflatable elastic toroidal bladder, the pressure gauge being attached to an upper surface of the rigid circular platform;

adjustable leveling feet positioned on a bottom surface of the base, each adjustable leveling foot including a foot and a threaded stud that is advanced into or retracted from a threaded hole in the base; and a bubble level indicator attached to the base, to facilitate leveling the base.

2. The balance exerciser of claim 1, the external pump consisting of one of: an air stand pump, an air hand pump, an air foot pump, and an air electric pump.

3. A balance exerciser, consisting of:

a central support for a ball joint disposed on a base;

an inflatable elastic toroidal bladder disposed on the base and centered about the central support;

a rigid circular balance platform whose center is fixed to the ball joint on its lower surface and whose periphery is supported by the inflatable elastic toroidal bladder, the rigid circular balance platform tilting about the ball joint in any direction of the horizontal x-y plane;

an external pump disposed externally to the rigid circular balance platform and the base, the external pump being connected to a valve stem of an air line to inflate the inflatable elastic toroidal bladder and being disconnected from the valve stem to deflate the inflatable elastic toroidal bladder, the inflatable elastic toroidal bladder being deflated by disconnecting the external pump from the valve stem and deflecting a stem of the valve stem sideways to allow air to escape the inflatable elastic toroidal bladder;

a pressure gauge connected to the inflatable elastic toroidal bladder and being attached to an upper surface of the rigid circular balance platform;

adjustable leveling feet positioned on a bottom surface of the base, each adjustable leveling foot including a foot and a threaded stud that is advanced into or retracted from a threaded hole in the base; and a bubble level indicator attached to the base, to facilitate leveling the base.

4. A balance exerciser, consisting of:

a central support for a ball joint disposed on a base;

an inflatable elastic toroidal bladder disposed on the base and centered about the central support;

a rigid circular balance platform whose center is fixed to the ball joint on its lower surface and whose periphery is supported by the inflatable elastic toroidal bladder, the rigid circular balance platform tilting about the ball joint in any direction of the horizontal x-y plane;

an external pump disposed externally to the rigid circular balance platform and the base, the external pump being connected to a flow control valve to one of: inflate and deflate the inflatable elastic toroidal bladder, the flow control valve connecting to a pressure gauge, which indicates a pressure of the inflatable elastic toroidal bladder, and to an air line that connects to the inflatable elastic toroidal bladder, the pressure gauge being attached to an upper surface of the rigid circular platform;

adjustable leveling feet positioned on a bottom surface of the base, each adjustable leveling foot including a foot and a threaded stud that is advanced into or retracted from a threaded hole in the base; and a bubble level indicator attached to the base, to facilitate leveling the base.

* * * * *